United States Patent [19]

Wien et al.

[11] 3,997,857

[45] Dec. 14, 1976

[54] INTEGRAL MAGNETIC TRIP AND LATCH FOR A CIRCUIT INTERRUPTER

[75] Inventors: Raymond E. Wien, Penn Township, Pa.; John F. Cotton, Athens, Ga.; Jack G. Hanks, Bethel Park, Pa.

[73] Assignee: Westinghouse Electric Corporation, Pittsburgh, Pa.

[22] Filed: Sept. 11, 1975

[21] Appl. No.: 612,609

[52] U.S. Cl. ..... 335/35; 335/37; 337/78

[51] Int. Cl.[2] ..... H01H 75/12

[58] Field of Search ..... 335/35, 36, 37, 45; 337/75, 78

[56] References Cited

UNITED STATES PATENTS

| | | | |
|---|---|---|---|
| 3,178,535 | 4/1965 | Gelzheiser et al. | 335/36 |
| 3,288,965 | 11/1966 | Klein | 335/37 X |
| 3,353,128 | 11/1967 | Gauthier | 335/35 |
| 3,548,358 | 12/1970 | Klein | 335/35 X |

*Primary Examiner*—George Harris
*Attorney, Agent, or Firm*—R. E. Converse, Jr,

[57] ABSTRACT

A circuit interrupter having a magnetic trip element which is integral with the latch. The disclosed circuit interrupter is provided with a bimetal and a magnetic trip element directly connected to the latch of the circuit interrupter which is drawn towards the bimetal, unlatching the circuit interrupter when current flow therethrough exceeds a high overload level. The disclosed circuit interrupter is particularly adaptable for use on a distribution transformer. A movable bridging contact for completing a series circuit between two stationary contacts is provided. The movable bridging contact is spring biased towards an open position separated from the stationary contacts, but with the circuit interrupter in the normally closed position is held in engagement with the stationary contacts by a latching mechanism which is responsive to the bimetal or magnetic trip element to allow the circuit breaker to trip open during overload conditions. The magnetic trip element is formed integral with the latching mechanism to reduce time delay before operation. A plurality of poles are operated using only one operating mechanism by connecting the elongated operating arms with a strong metallic member for simultaneous operation of all poles. The bridging contact is disposed near the end of an elongated operating arm which is linked to the circuit breaker operating mechanism. Each pole of the circuit interrupter is provided with a bimetallic trip element. The magnetic trip element can be formed from a single piece having a plurality of legs each disposed in proximity with the bimetal of one pole.

8 Claims, 6 Drawing Figures

INTEGRAL MAGNETIC TRIP AND LATCH FOR A CIRCUIT INTERRUPTER

BACKGROUND OF THE INVENTION

1. Field of the Invention

This invention relates to circuit interrupters of the type having a bimetallic thermal conduit trip element and a magnetic instantaneous element, and more particularly, to circuit breakers for distribution transformers to control moderate power distribution on feeder circuits.

2. Description of the Prior Art

Transformers used in power distribution systems are generally associated with a protective device which prevents or limits current overload damage to the transformer and its associated apparatus. A completely self-protected transformer includes a circuit interrupter on the secondary or low voltage side to protect against damage due to overload current. The secondary circuit interrupter disconnects the transformer from its load if the load current becomes dangerously high. The secondary circuit interrupter is normally disposed beneath the insulating oil of the transformer to take advantage of its superior dielectric strength.

Commonly used circuit interrupters often incorporated a bimetal thermal trip and an instantaneous magnetic trip. For high overload currents it is desirable that the circuit interruption be completed as rapidly as possible after initiation.

SUMMARY OF THE INVENTION

An oil filled distribution transformer having a secondary circuit interrupter disposed in the oil with a bimetal trip element and an integral magnetic trip and latch construction. The magnetic trip element which is integral with the latch eliminates the time delay associated with the conventional magnetic trip unlatching device for circuit interrupters. Combining functions into a single piece of hardware also provides a cost savings advantage. The disclosed device also provides a means for obtaining a multiplication of the magnetic force to unlatch the circuit interrupter.

The disclosed circuit interrupter utilizes a bridging contact supported from the free end of a pivoted elongated contact arm and being movable between an open position spaced from a pair of stationary contacts, and a closed position engaging the stationary contacts, to complete a series circuit through the transformer to a low voltage terminal located on the transformer housing. The bridging contact is spring biased towards the open position spaced from the pair of stationary contacts, but when the circuit interrupter is closed the bridging contact is held in engagement with the pair of stationary contacts by a latching mechanism. A bimetal actuating means which is disposed in series in the circuit through the transformer is connected so that when current flow therethrough exceeds an overload trip value the bimetal actuating means moves the latch to an unlatched position, permitting the circuit interrupter to trip open. A magnetic trip which is securely connected to the latching mechanism for unitary movement therewith is disposed with leg portions in proximity to the bimetals. During high overloads the magnetic trip element is drawn towards the bimetal, unlatching the circuit breaker and permitting the circuit to be opened.

The disclosed transformer secondary circuit breaker utilizes a single toggle and latching mechanism for operating two or three poles. Each pole is provided with a separate bimetal trip. The magnetic trip, which can be a single piece, is directly connected to the latch and has a flat leg portion disposed in proximity to each bimetal for tripping the circuit interrupter when current flow through any pole exceeds a predetermined high overload value.

The contact arms of the various poles are rigidly connected to a metallic shaft which has relatively high strength for simultaneous movement.

It is an object of the present invention to teach a circuit interrupter having a magnetic trip element which is directly connected to a portion of the circuit interrupter latch for rapid operation.

BRIEF DESCRIPTION OF THE DRAWINGS

For a better understanding of this invention reference may be had to the preferred embodiments exemplary of this invention shown in the accompanying drawings, in which.

DESCRIPTION OF THE PREFERRED EMBODIMENTS

Figure 1:
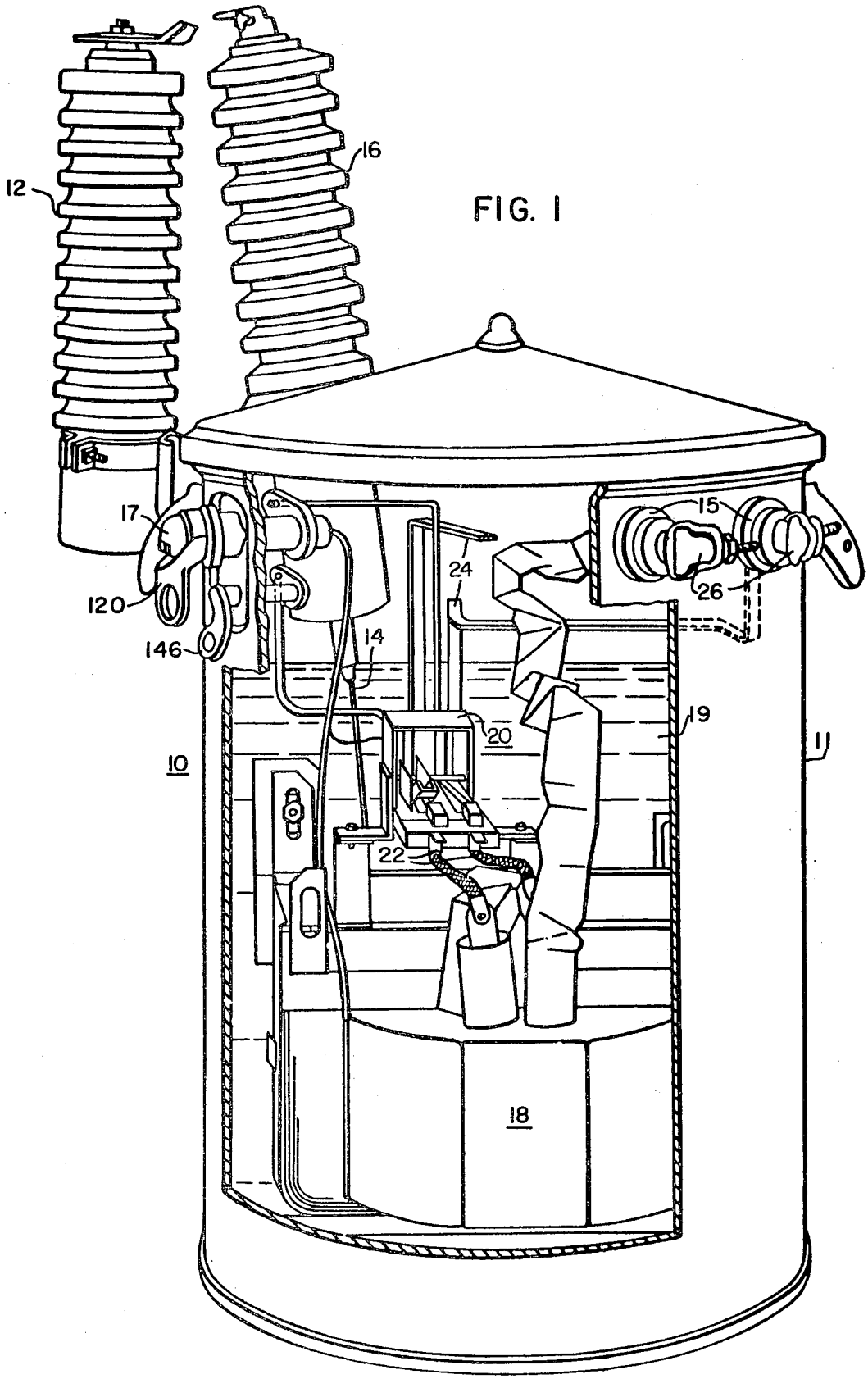
FIG. 1 is a perspective view of an oil-filled distribution transformer utilizing the teaching of the present invention.

Referring now to the drawings, and FIG. 1 in particular, there is shown a pole type completely self-protected distribution transformer 10 including a circuit breaker 20 utilizing the teaching of the present invention. The transformer 10 includes an enclosure or tank 11 with a lightning arrestor 12 and a primary high voltage bushing 16 mounted thereon. Secondary bushings, such as the low voltage bushings 15, are attached to the enclosure 11 to which the transformer load is connected. A signal light 17 is mounted on the enclosure 11 and is electrically connected to the circuit breaker 20 to be actuated at a predetermined low overload. The core and coil assembly 18 is secured inside the enclosure 11 with the circuit breaker 20 attached thereto. Required primary winding leads 14 extend from the core and coil assembly 18 to the appropriate high voltge bushings 16. The housing 11 is partially filled with an insulating liquid dielectric 19, such as transformer oil. The circuit breaker 20 and the core and coil assembly 18 are immersed in the insulating oil 19. Secondary connections 22, coming from the core and coil assembly 18, connect to input terminals on circuit breaker 20. Conductors 24 connect the output terminals of circuit breaker 20 to the low voltage bushings 15 mounted to the transformer tank 11. Appropriate loads can then be connected to the low voltage terminals 26 of the distribution transformer 10.

Figure 2:
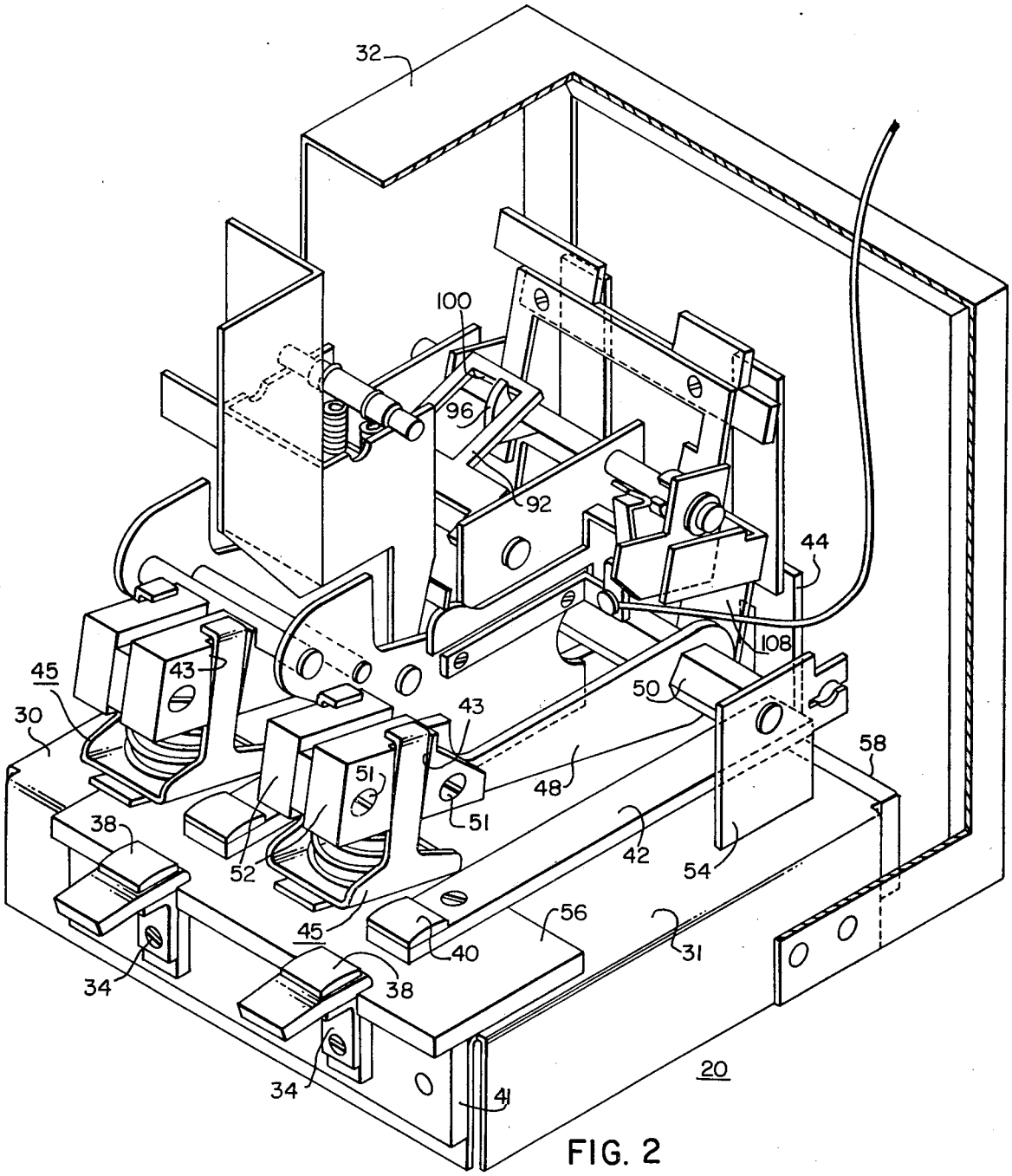
FIG. 2 is a perspective view of secondary circuit interrupter for use on a distribution transformer utilizing the teaching of the present invention.
Figure 4:
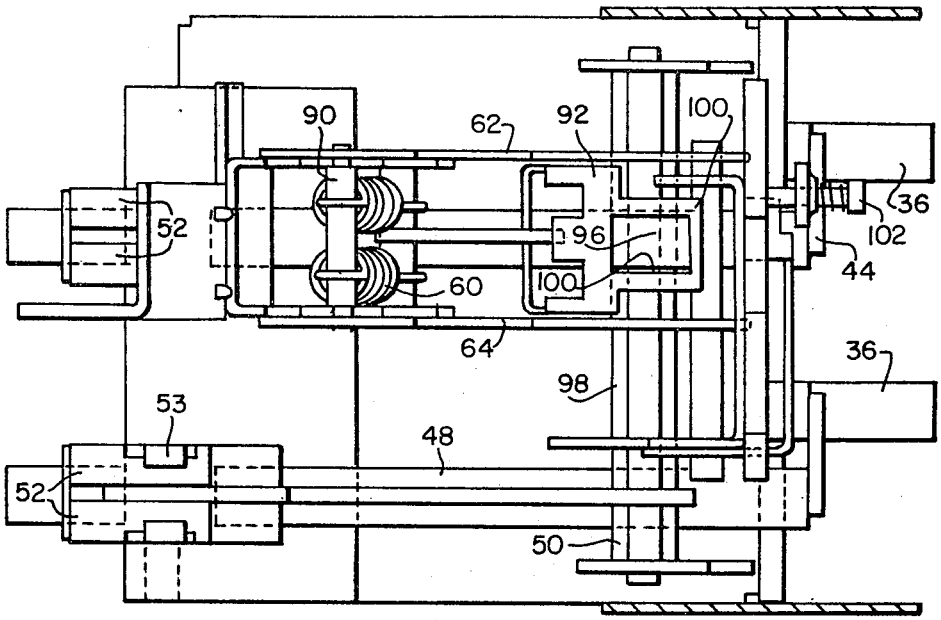
FIG. 4 is a side view of the circuit interrupter shown in FIG. 3 with portions broken away for clarity.
Figure 3:
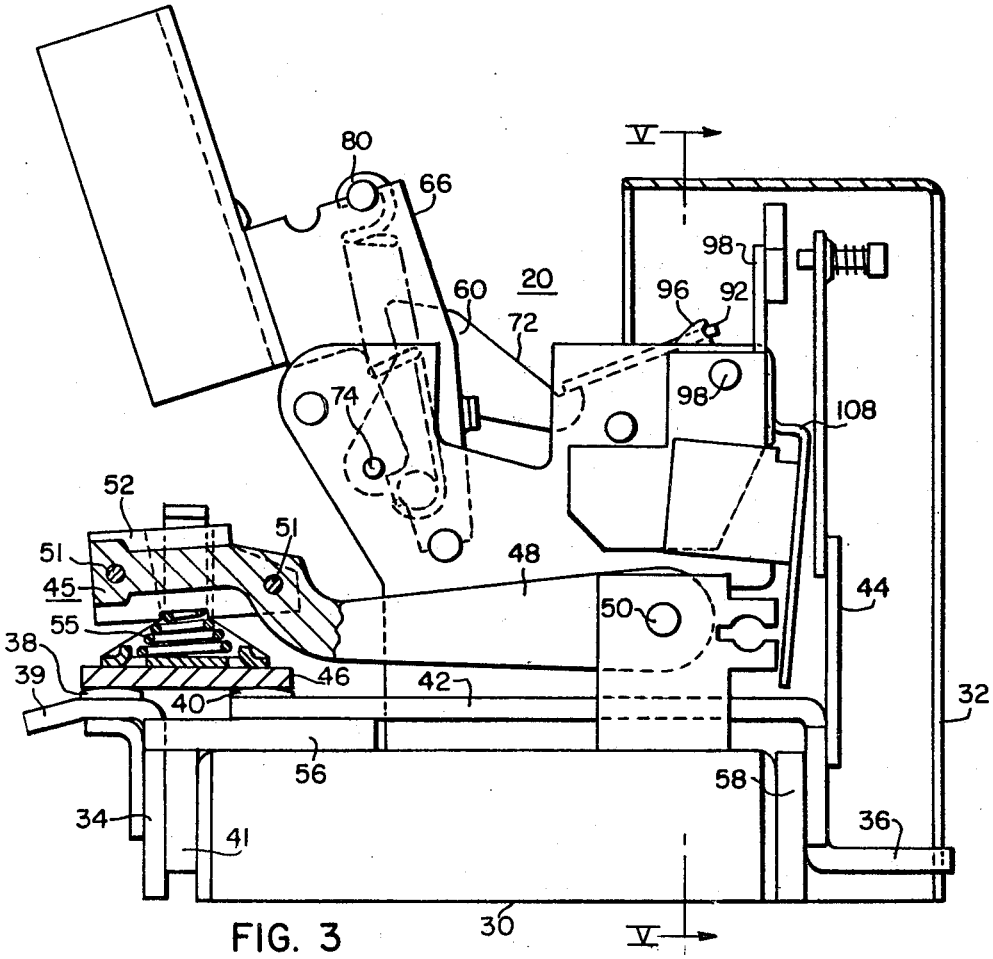
FIG. 3 is a top view of the circuit interrupter shown on FIG. 2 with the contacts in the closed position.
Figure 5:
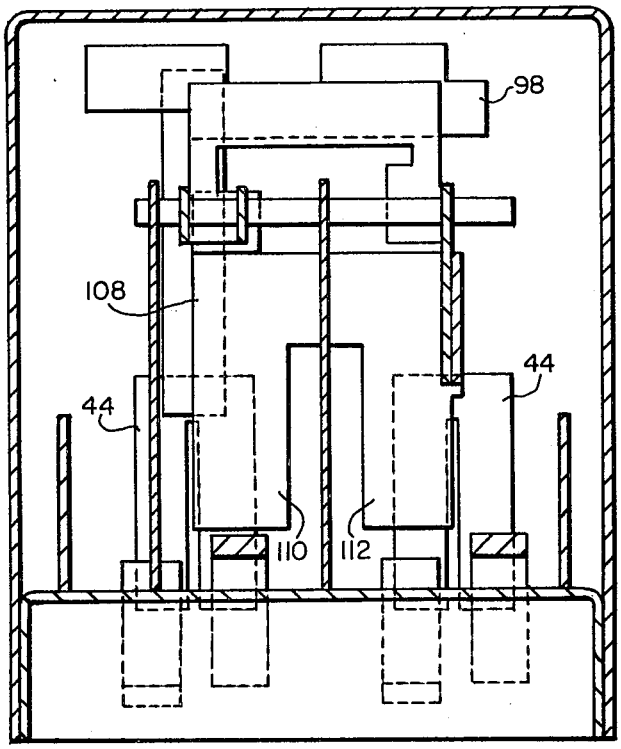
FIG. 5 is a sectional view of the circuit interrupter shown in FIG. 4 taken along the lines V—V; and, FIG. 6 is a perspective view of a portion of the circuit interrupter shown in FIG. 2 which clearly shows the one piece magnetic trip.
Figure 6:
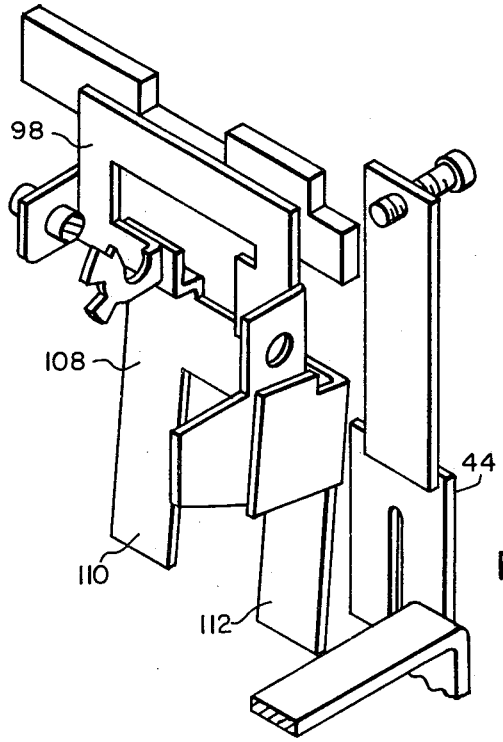

Referring now to FIGS. 2 through 5, there are shown embodiments of circuit breaker 20 utilizing the teaching of the present invention. FIG. 2 shows a perspective view of a two pole circuit breaker utilizing the teaching of the present invention. The circuit interrupter 20 is mounted on a metallic base 30. A cover 32 is provided partially surrounding the sensing and tripping elements of the circuit breaker 20 to provide protection during handling. Secondary leads 22 of the core and coil assembly 18 are attached to incoming circuit breaker terminals 34. Electrical conductors 24, disposed between the circuit breaker 20 and the low voltage transformer bushings 15, attach to circuit breaker 20 at terminals 36. Circuit breker terminals 34 connect to stationary contacts 38. Circuit breaker terminals 36 connect to stationary contact 40 through electrical conductor 42 and bimetal 44. Stationary contacts 38 and 40 of each pole are disposed in a spaced apart relationship. A bridging contact 46 is provided which, with the circuit breaker in the closed position, completes an electrical connection between stationary contacts 38 and 40. Thus, with the circuit interrupter 20 closed an electric circuit is completed from a terminal 34 through stationary contact 38, through bridging contact 46, through stationary contact 40, through electrical conductor 42, through bimetal 44, to circuit breaker terminal 36. The bridging contact assembly 45 includes the movable bridging contact 46 attached to one portion thereof which, when the circuit interrupter is closed, completes an electrical connection between stationary contacts 38 and 40.

In the disclosed distribution transformer the bridging contact is located below the bimetal 44. This is a most desirable feature since if for any reason a transformer should devlelop an oil leak the bimetal will be first to be exposed above the oil in the gas space and will heat up rapidly causing the breaker to trip while the contacts 46, 38 and 40 are still under the oil. This sequence of operation is desirable since it prevents contact arcing in the volatile gas space above the reduced oil level.

Each pole of the circuit breaker 20 is provided with an elongated contact arm 48 which at one end is rigidly secured to a through shaft 50. Shaft 50, which can be a metallic member, connects together the elongated contact arms 48 of all poles of the circuit interruter 20 for simultaneous movement. That is, the contact arms 48 are connected together through shaft 50 so they move in unison. The bridging assembly 45 is connected to the end of the elongated contact arm 48 opposite shaft 50. An insulating member 52 is provided at the end of contact arm 48 so that contact arm 48 is electrically insulated from the contact bridging assembly 45. A spring 55 is provided in contact assembly 45 to provide uniform contact pressure and proper seating of the bridging contact 46 on the stationary contacts 38 and 40. As can be seen from the drawings when any one of the poles of the circuit interrupter 20 open all the other poles must also open.

Through shaft 50 is rotatably supported by brackets 54 which are attached to the metallic base 30. Stationary contacts 38 and 40 are electrically insulated from base plate 30 by insulating sheet 56 which is secured to base plate 30. Terminal 36 is connected to insulating sheet 58 which is rigidly secured to base plate 30. Electrical conductor 42 is insulated from base plate 30 by insulating sheets 56 and 58 and transformer oil 19 which fills the open spaces in the circuit interrupter 20 during normal operation. Conductor 42 which is generally L-shaped has its short leg portion attached to one leg of bimetal 44. The other leg of bimetal 44 attaches to L-shaped terminal 36.

A single operating mechanism 60 is provided for operating all poles of the circuit interrupter 20. Operator 60 is connected to one of the elongated contact arms 48 and as this contact arm 48 is moved, in response to the positioning of the operator 60, the other elongated contact arm 48, connected through shaft 50, also responds. The single operating mechanism 60 for all poles is mounted on side plates 62 and 64 which are securely attached to support base 30. The operating mechanism comprises a U-shaped operating member 66, the two legs of which are pivotally connected to side plates 62 and 64. A primary latch 72 is provided and is pivotally connected to a shaft 74 disposed between side plates 62 and 64. A pair of toggle links are provided with one end of the toggle connected to the elongated contact arm 48 and the other end of the toggle connected to primary latch 72 and having multiple springs 80 connected between the knee of the toggle and the top of U-shaped member 66 for raising contact arm 48 with a snap action when primary latch 72 is released. The toggle links are pivotally connected together by a knee pivot pin. The lower toggle member is connected at its lower end by pivot pin to elongated contact arm 48. The upward force exerted by springs 80 holds the toggle links in engagement with primary latch 72. Primary latch 72 is releasably held in a latched position by secondary latch 92. Secondary latch 92 is biased toward an unlatched position by a torsion spring. When secondary latch 92 moves to the unlatched position primary latch 72 is released and rotates due to the force of springs 80 collapsing the toggle and raising the elongated contact arm 48.

Secondary latch 92 is prevented from moving to the unlatched position when the breaker is closed by a cam surface 96 which is part of a trip bar mechanism 98. As can be seen with the circuit breaker normally closed, a portion of secondary latch 92 rests against the cam surface 96. When the trip bar mechanism is rotated a predetermined angle the cam surface 96 passes through opening 100 in secondary latch 92 permitting secondary latch 92 to rotate to the unlatched position releasing primary latch 72 and tripping open the circuit breaker 20. Trip bar mechanism 98 is connected to be rotated by current responsive means when the current through the circuit breaker 20 exceeds a predetermined value.

Each pole of the circuit breaker 20 is provided with an individual current responsive bimetal trip element 44, through which the load current of the associated pole passes. That is, the bimetal element 44 is electrically connected in the circuit of the circuit breaker 20 in series relation with the breaker contacts 38, 40 and 46. The bimetal 44 is generally U-shaped with an adjusting screw 102 threadedly mounted in the bight portion. One leg of the bimetal 44 is connected to fixed conductor 42 and the other leg of bimetal 44 is connected to fixed terminal 36. Adjusting screw 102 is disposed so as to contact an insulating portion of trip bar mechanism 98 when bimetal 44 deflects. Upon occurrence of, for example, an overload of less than 500% of normal rated current, the bimetal element is heated and deflects toward the trip bar mechanism 98. As the bimetal element deflects due to flow of current therethrough, the rounded edge of adjusted screw 102 engages the insulating sheet attached to trip bar mechanism 98, rotating the trip bar 98 counterclockwise to a tripped position releasing secondary latch 92 and tripping open the circuit interrupter 20. The cam portion 96 of trip bar mechanism 98 moves from under the latching surface to release the secondary latch 92. Primary latch 72 then rotates around pivot 74 moving the line of action of the springs 80 to the left of toggle pivot knee causing the toggle to collapse and open the circuit interrupter 20 with a snap action.

Operating member 66, which provides a connection for one end of springs 80, is mechanically linked to an operating handle 120 disposed on the transformer tank 11. Operating handle 120 is movable between an on position closing the circuit breaker 20 and an off position opening circuit breaker 20. The circuit breaker contacts 38, 40 and 46 are manually opened by clockwise movement of operating member 66, as operating handle 120 is moved to the off position. Contacts are closed by counterclockwise movement of the operator 66. This moves the line of action of the springs 80 across to the left, consequently the springs 80 actuate the toggle to its extended overcenter position, thereby moving the movable bridging contact 46 to the closed position with a snap action.

The circuit interrupter 20 is held in the closed position by primary latch 72 which is rotatable about pivot point 74. The latching surface on primary latch 72 is engaged by a portion of secondary latch 92 to hold primary latch 72 in the latched position. When secondary latch 92 rotates in a clockwise direction primary latch 72 is released.

An electromagnetic actuator 108 which forms a significant part of the present invention is also provided to instantaneously trip the breaker. Electromagnetic actuator 108 is securely connected to trip bar 98 for unitary movement therewith. The electromagnetic actuator 108 comprises a single piece ferromagnetic member which is rigidly secured to trip bar 98. Member 108, for a two pole circuit interrupter, has two leg portions 110 and 112 with each leg disposed in proximity to a bimetal 44 of the associated pole. The current for each pole flow through the associated bimetal 44. When a high enough overload current flows through the portion of bimetal 44 the associated leg portion 110 or 112 is drawn thereto, tripping open the circuit interrupter 20. For a three pole breaker ferromagnetic member 108 can be provided with three leg portions. Thus a single ferromagnetic member 108 can provide high overload protection for a number of poles. The magnetic trip 108 which is integral with the trip bar 98 of the secondary latch provides a force multiplier for the magnetic trip and eliminates some of the mechanical delay inherent in multiple part systems. Combining the magnetic trip function with the latching function in one piece of hardware also provides a cost advantage.

When the circuit interrupter 20 has tripped open, the primary latch 72 and the secondary latch 92 must be reset to a latched position before the circuit breaker can be closed. Relatching of the operating mechanism is effectuated by movement of the operator handle beyond the off position. The circuit breaker 20 may then be closed by movement of the operating handle 120 to the on position causing the circuit breaker 20 to close in the previously described manner.

We claim:

1. A circuit interrupter comprising:

a first stationary contact;

a second stationary contact separated from said first stationary contact;

bridging contact means;

an elongated contact arm having said bridging contact means connected thereto, pivotal about an axis between a closed position wherein said bridging contact means completes an electric circuit between said first stationary contact and said second stationary contact and an open position wherein said bridging contact means is spaced apart from said first stationary contact and said second stationary contact;

primary latch means connected to said elongated contact arm when in a latching position latching said elongated contact arm in the closed position;

a secondary latch in a latched position keeping said primary latch means in the latched position;

bimetal actuating means responsive to current flow for unlatching said secondary latch when current flow through the circuit interrupter exceeds a selected trip level for a predetermined period of time; and, a magnetically responsive trip rigidly connected to said secondary latch having a portion disposed in proximity to said bimetal actuating means to be drawn toward said bimetal actuating means unlatching said secondary latch when current flow through said bimetal actuating means exceeds a high current overload level.

2. A circuit interrupter as claimed in claim 1 wherein said secondary latch comprises a retainer supported for rotary movement around a fixed axis between a first position latching said secondary latch and a second position releasing said secondary latch, said magnetically responsive trip being connected to said retainer for unitary movement therewith to move said retainer towards the second position when said magnetically responsive trip is drawn towards said bimetal actuating means.

3. A circuit interrupter comprising:

a base;

a stationary contact supported from said base;

a movable contact;

an elongated contact arm, having a pivoted end supported from said base and having a free end with said movable contact attached thereto, said elongated contact arm being pivotal between a closed position wherein said stationary contact and said movable contact are in engagement and an open position wherein said movable contact and said stationary contact are spaced apart;

spring biasing means connected to said elongated contact arm for biasing said elongated contact arm to the open position;

a primary latch connected to said elongated contact arm having a latch position latching said elongated contact arm in the closed position and an unlatched position releasing said elongated contact arm;

a secondary latch movable between a first position latching said primary latch in the latched position and a second position releasing said primary latch;

a bimetal connected in series with said movable contact and said stationary contact for current flow therethrough and positioned in proximity to said secondary latch so as to move said secondary latch to the second position when current flow through said bimetal exceeds a first predetermined overload current level; and, a magnetic trip directly connected to said secondary latch and having a portion disposed in proximity to said bimetal for moving said secondary latch to the second position when current flow through said bimetal exceeds a second predetermined overload level.

4. A circuit interrupter as claimed in claim 3 comprising:

a second stationary contact supported from said base;

a second movable contact;

a second elongated contact arm, having a pivoted end suported from said base and having a free end with said second movable contact attached thereto, said arm being pivotal between a closed position wherein said stationary contact and said movable contact are in engagement and an open position wherein said movable contact and said stationary contact are spaced apart;

an elongated relatively rigid shaft connecting said elongated contact arm and said second elongated contact arm for unitary movement;

a second bimetal connected in series with said second stationary contact and said second movable contact to move said secondary latch to the second position when current flow through said second bimetal exceeds said first predetermined current level; and, said magnetic trip including a portion directly connected to said secondary latch and having a portion disposed in proximity to said second bimetal for moving said secondary latch to the second position when current flow therethrough exceeds said second high overload level.

5. A circuit interrupter as claimed in claim 4 wherein said magnetic trip means comprises a generally U-shaped member having a first leg disposed in proximity to said bimetal and having a second leg disposed in proximity to said second bimetal.

6. A circuit interrupter as claimed in claim 3 wherein:

said secondary latch comprises a retainer supported for rotary movement about a fixed axis between a first position latching said secondary latch and a second position releasing said secondary latch; and, said magnetic trip is directly connected to said retainer for unitary movement therewith.

7. A circuit interrupter comprising:

a stationary contact;

a movable contact movable between a closed position in engagement with said stationary contact and an open position spaced apart from said stationary contact;

biasing means for biasing said movable contact to the open position spaced apart from said stationary contact;

a latch for latching said movable contact in the closed position;

a latch retainer movable between a first position keeping said latch in a latched position holding said movable contact in the closed position and a second position allowing said latch to move to an unlatched position permitting said movable contact to move to the open position;

a bimetal connected for circuit interrupter current flow therethrough disposed to move said latch retainer to the second position under selected current overloads; and, a magnetic trip connected to said latch retainer for unitary movement therewith and having a portion positioned in proximity to said bimetal so as to be drawn toward said bimetal at a predetermined overload current, therey moving said unitarily connected latch retainer to said second position.

8. A circuit interrupter as claimed in claim 7 wherein:

said latch retainer is supported for pivotal movement about a fixed axis; and, said magnetic trip comprises a magnetizable member securely connected to said latch retainer for rotational movement about the same axis as said latch retainer.

* * * * *